US009296237B2

(12) United States Patent
Groenen et al.

(10) Patent No.: US 9,296,237 B2
(45) Date of Patent: Mar. 29, 2016

(54) METHOD FOR ESTABLISHING A MAINTENANCE TIME INTERVAL FOR A PRINTING DEVICE

(71) Applicant: OCE-TECHNOLOGIES B.V., Venlo (NL)

(72) Inventors: Paulus A. C. Groenen, Venray (NL); Johannes B. M. Sevenich, Roermond (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/825,253

(22) Filed: Aug. 13, 2015

(65) Prior Publication Data

US 2015/0343819 A1 Dec. 3, 2015

Related U.S. Application Data

(63) Continuation of application No. PCT/EP2014/052122, filed on Feb. 4, 2014.

(30) Foreign Application Priority Data

Feb. 18, 2013 (EP) ..... 13155605

(51) Int. Cl.
*B41J 2/165* (2006.01)
*B41J 29/38* (2006.01)

(52) U.S. Cl.
CPC ..... *B41J 29/38* (2013.01); *B41J 2/16517* (2013.01); *B41J 2002/16573* (2013.01)

(58) Field of Classification Search
CPC ..... B41J 2002/16573
USPC ..... 347/23
See application file for complete search history.

(56) References Cited

U.S. PATENT DOCUMENTS 6,338,540 B1 * 1/2002 Hasegawa ..... B41J 2/1652 347/23
2005/0062792 A1 * 3/2005 Kojima ..... B41J 2/16526 347/23

(Continued)

FOREIGN PATENT DOCUMENTS

EP 0 879 701 A2 11/1998
EP 1 967 366 A2 9/2008

OTHER PUBLICATIONS

Written Opinion of the International Searching Authority; PCT/ISA/237; pp. 1-4.

*Primary Examiner* — Shelby Fidler
(74) *Attorney, Agent, or Firm* — Birch, Stewart, Kolasch & Birch, LLP

(57) ABSTRACT

A method of establishing a time interval between maintenance actions expressed in pages for a printing device, includes determining the number of pages of an incoming print job, comparing the determined number of pages to a predetermined time interval between the maintenance actions expressed in pages, changing the predetermined time interval into at least one new time interval between the maintenance actions expressed in pages based on the comparison, printing the incoming print job, and carrying out at least one maintenance action after the start of printing of the incoming print job according to the at least one new time interval. A printing device includes a print unit and a print controller for planning maintenance actions on the print unit according to the method.

11 Claims, 10 Drawing Sheets

(56) References Cited

U.S. PATENT DOCUMENTS

2007/0146411 A1* 6/2007 Robertson ..... B41J 2/16526 347/22
2007/0291074 A1 12/2007 Kawamata et al.
2008/0218554 A1 9/2008 Inoue
2012/0062628 A1 3/2012 Nagai
2012/0229565 A1 9/2012 Yuda et al.

* cited by examiner

METHOD FOR ESTABLISHING A MAINTENANCE TIME INTERVAL FOR A PRINTING DEVICE

CROSS-REFERENCE TO RELATED APPLICATIONS

This application is a Continuation of International Application No. PCT/EP2014/052122, filed on Feb. 4, 2014, and for which priority is claimed under 35 U.S.C. §120. PCT/EP2014/052122 claims priority under 35 U.S.C. §119(a) to Application No. 13155605.2, filed in Europe on Feb. 18, 2103. The entire contents of each of the above-identified applications are hereby incorporated by reference into the present application.

BACKGROUND OF THE PRESENT INVENTION

1. Field of the Invention

The present invention relates to a method of establishing a time interval between consecutive maintenance actions for a printing device, the method comprising the steps of determining a job time needed to print an incoming print job.

2. Description of Background Art

For a printing device, especially an inkjet based printing device, a marking material quality and placement, degrades during printing. The marking material may be ink drops, toner particles, etc. After some time, a maintenance action may be initialized to clean and wipe the print unit. The print unit may be a print head, a photovoltaic image forming unit, a direct imaging processing drum, etc. After this procedure, the quality of the print unit is refreshed and the quality of the prints will be correct. However, the maintenance action has to be repeated in time.

In case of an inkjet printer, a method is known from U.S. Patent Application Publication No. 2007/0291074, wherein an ink jet printing device determines a timing of executing a discharge recovery processing based on the discharge amount of ink for each predetermined region discharged from a recording head in a multi-pass mode. This is disadvantageous, since when a print job is to be printed on the printing device, a maintenance action may be invoked during the print job at a moment that leads to a decrease of the average print quality of the print job.

SUMMARY OF THE PRESENT INVENTION

It is an objective of the present invention to provide a method for establishing a time interval between maintenance actions to achieve a higher average print quality of a print job.

This objective is achieved by the method according to the present invention, wherein the method comprises the steps of: determining a job time needed to print an incoming print job; comparing the determined job time to a predetermined maximum allowed time interval between the maintenance actions; if the determined job time is larger than the maximum allowed time interval, scheduling a plurality of maintenance actions, at least one maintenance action during the printing of the print job and a maintenance action at the end of the print job being such that for each pair of consecutive maintenance actions, a time interval between the consecutive maintenance actions of each pair is smaller than the predetermined maximum allowed time interval and the plurality of maintenance actions are substantially equidistantly distributed in time; if the determined job time is not larger than the maximum allowed time interval scheduling a maintenance action after printing of the incoming print job; and printing the incoming print job, including carrying out the at least one scheduled maintenance action.

Research by the applicant has shown that the print quality is inversely proportional with the determined job time. Therefore, a larger number of maintenance actions will result in a better print quality during the job. The applicant has recognized that, even if the number of maintenance actions during the print job remains equal, the timing of the maintenance action during the print job determined according to the present invention leads to less print quality fluctuations during the print job. The determined job time may be expressed as a time unit or as a number of pages to be printed.

If the determined job time is less than the predetermined maximum allowed time interval between the maintenance actions, the next maintenance action may be after the last print of the job or after the last print of a successive job as long as the predetermined maximum allowed time interval is not usurped during the job next to the successive job. When the predetermined maximum allowed time interval is usurped by a next job to the successive job, the maintenance action may be scheduled at the end of the successive job, thereby changing the time interval between the maintenance actions.

If the predetermined job time of the print job is more than the predetermined maximum allowed time interval between the maintenance actions, the time interval between the maintenance actions may be changed into a smaller time interval. For each pair of consecutive maintenance actions, the time interval between the consecutive maintenance actions of each pair is smaller than the predetermined maximum allowed time interval. This may result in an equal number or larger number of maintenance actions during the print job according to the time interval. Research by the applicant has shown that the print quality is inversely proportional with the job time. Therefore, a larger number of maintenance actions will result in a better print quality during the job. Even if the number of maintenance actions during the print job remains equal, the timing of the maintenance action during the print job may be chosen to lead to less print quality differences during the job. This may be achieved by determining the time interval such that the maintenance actions are distributed equidistantly in time and so a reduction of the differences between the number of pages between each pair of consecutive maintenance actions is achieved. The number of pages between each pair of consecutive maintenance actions may be approximately equalized. The method according to the present invention leads to a better print quality without additional cost of time: in most cases the number of maintenance actions during a print job stays the same. This leads to a better balance of productivity versus print quality. The method also improves the prevention of contamination of the print heads due to the smaller maintenance time intervals. Also, an improvement of the print head life time is to be expected.

According to the method of the present invention, the scheduling step, when the job time is larger than the predetermined maximum allowed time interval, establishes a coincidence of a maintenance action with the end time of the print job. This is in particular advantageous when there is idle time between successive jobs. This idle time is usable to initiate a maintenance action.

According to an embodiment of the present invention, the number of pages between the maintenance actions during the print job is substantially the same. This is advantageous because this effectuates that within a job, the average print quality between the maintenance actions is substantially the same.

According to an embodiment of the present invention, the scheduling step of the plurality of maintenance actions establishes an equal number of maintenance actions during the print job as when the print job was carried out using the maximum allowed time interval. This is advantageous, since there is no loss of time during the job due to extra maintenance actions during the job.

According to an embodiment of the present invention, the time interval between consecutive maintenance actions of the plurality of maintenance actions is determined to have at most two different time period sizes. Each situation of print jobs and predetermined maximum allowed time interval can be dealt with when using at most two different time period sizes. Moreover, according to a further embodiment of the present invention, the two different time period sizes expressed in pages differ by only one page in number. Since in the latter case, the time intervals are approximately equalized, the average print quality in each time interval is also approximately the same.

According to an embodiment of the present invention, the step of scheduling the plurality of maintenance actions takes a utilization degree of each page of the print job into account. When a page is covered with images, the page utilization degree is higher than when the page is covered with text. If the first half of a document contains pages with only text and the second half of the document contains only images, a maintenance interval overlapping with the first half of the document may be larger than a maintenance interval overlapping with the second half of the document. The embodiment may be applied to changing the maintenance time intervals during one print job at a time.

According to an embodiment of the present invention, the printing device is a single pass inkjet printing device. Especially in fast speed single pass inkjet printing, the maintenance actions are crucial for a good print quality and need to be planned accurately with the least loss of productivity as possible for a predetermined print quality to be achieved.

According to an embodiment of the present invention, a kind of maintenance action is at least one of a cleaning action of the print head of the printing device, a wiping action of the print head of the printing device, and a flushing action of the print head of the printing device.

According to a further embodiment of the present invention, the predetermined maximum allowed time interval is differentiated with respect to the kind of maintenance actions. This gives an optimization of the productivity of the printing device.

According to an embodiment of the present invention, the maximum allowed time interval is differentiated with respect to a page size of the pages of the print job. A maintenance action will have to take place earlier in time when printing a number of large size pages than when printing a same number of small size pages. A page size may be A0, A1, A2, A3, A4, A5, A6, B0, B1, B2, B3, B4, B5, B6, Letter, Legal, etc. Differentiation of the time intervals to page sizes leads to more productivity of the printing device.

The present invention also relates to a printing device having a print unit and a print controller for planning maintenance actions on the print unit according to any one of the methods according to any of the previous embodiments. The printing device may have been installed with software and/or hardware for automatically performing the steps of the method according to the present invention.

The invention also relates to a non-transitory recording medium comprising computer executable program code configured to instruct a computer to perform the method according to any of the previous embodiments.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMEMTS

Figure 1A:
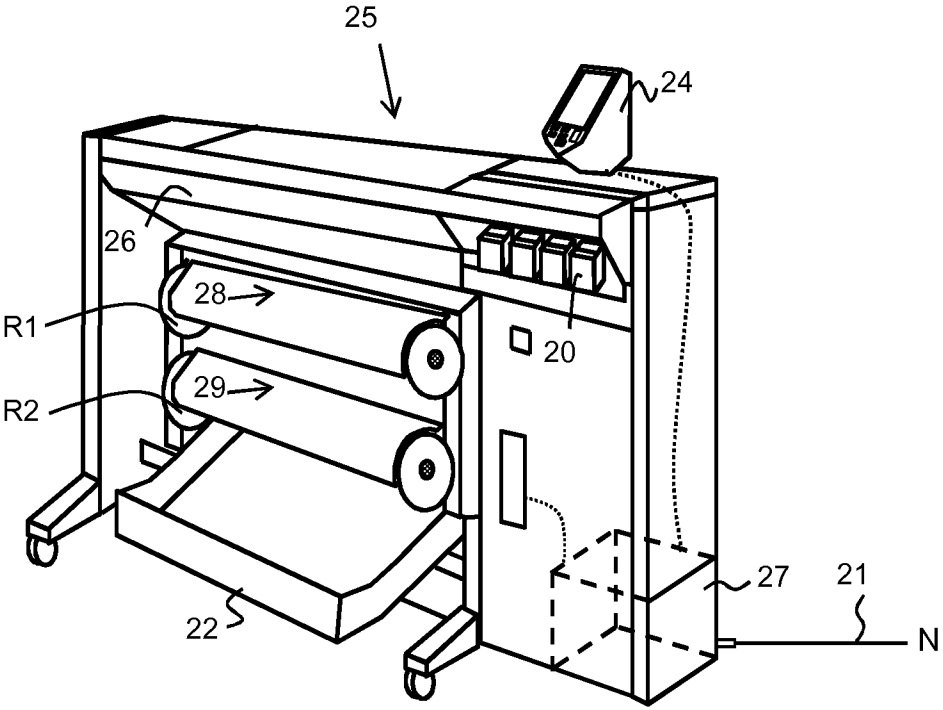
FIG. 1*a* is a perspective view of a printing system according to the background art.

The present invention will now be described with reference to the accompanying drawings, wherein the same reference numerals have been used to identify the same or similar elements throughout the several views.

Figure 1B:
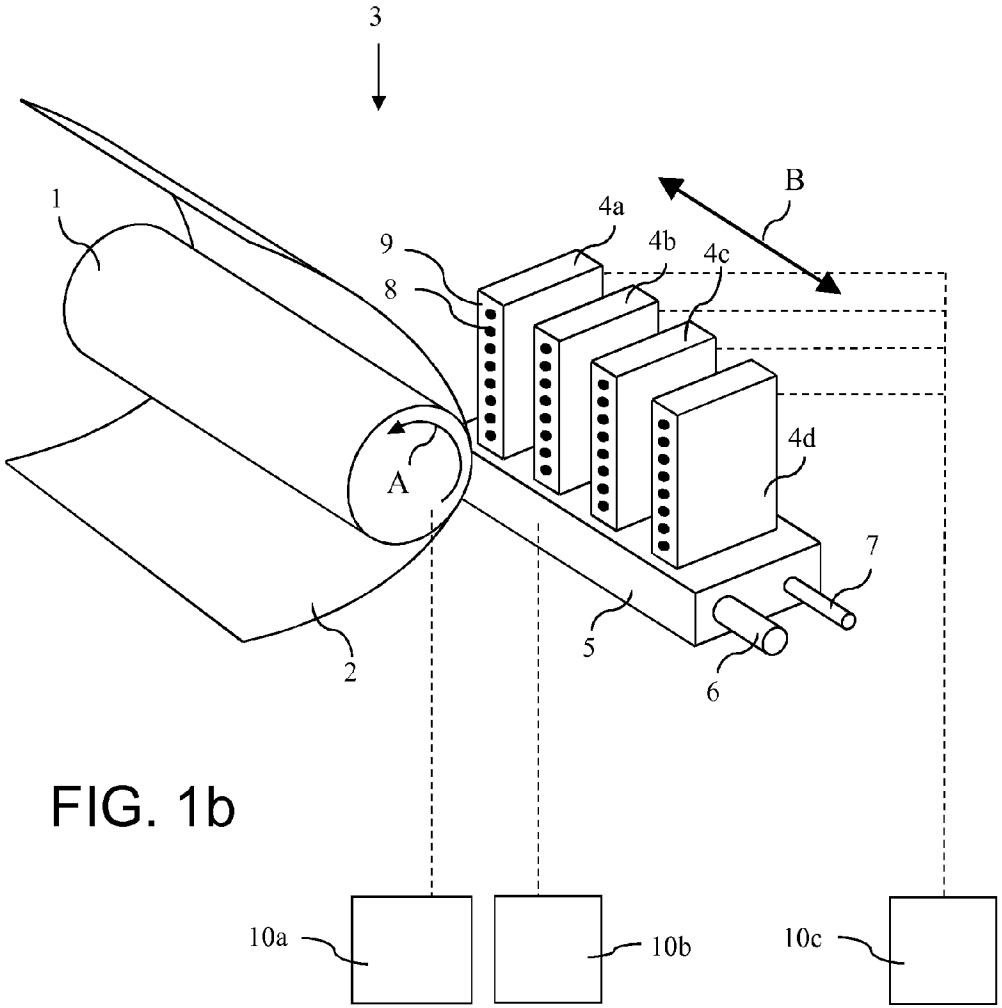
FIG. 1*b* is a schematic perspective view of an inkjet printing system, which may be used in the printing system of FIG. 1*a;*

FIG. 1*a* shows a printing device 25, wherein printing is achieved using a wide format inkjet printer. The wide-format image forming apparatus 25 comprises a housing 26, wherein the printing assembly, for example the ink jet printing assembly shown in FIG. 1*b* is placed. The printing device 25 also comprises a storage device configured to store an image receiving member 28, 29, a delivery station to collect the image receiving member 28, 29 after printing and a storage device configured to store a marking material 20. In FIG. 1*a*, the delivery station is embodied as a delivery tray 22. Optionally, the delivery station may comprise processing device configured to process the image receiving member 28, 29 after printing, e.g. a folder or a puncher. The wide-format printing device 25 furthermore comprises a device configured to receive print jobs and optionally a device configured to manipulate print jobs. These devices may include a user interface unit 24 and/or a control unit 27, for example a computer.

Images are printed on an image receiving member, for example paper, supplied by a roll 28, 29. The roll 28 is supported on the roll support R1, while the roll 29 is supported on the roll support R2. Alternatively, cut sheet image receiving members may be used instead of rolls 28, 29 of image receiving member. Printed sheets of the image receiving member, cut off from the roll 28, 29, are deposited in the delivery tray 22.

Each one of the marking materials for use in the printing assembly are stored in four containers 20 arranged in fluid connection with the respective print heads for supplying marking material to said print heads.

The local user interface unit 24 is integrated to the print engine and may comprise a display unit and a control panel. Alternatively, the control panel may be integrated in the display unit, for example in the form of a touch-screen control panel. The local user interface unit 24 is connected to a control unit 27 placed inside the printing device 25. The control unit 27, for example a computer, comprises a processor adapted to issue commands to the print engine, for example for controlling the print process and scheduling maintenance actions. The printing device 25 may optionally be connected to a network N. The connection to the network N is diagrammatically shown in the form of a cable 21, but nevertheless, the connection could be wireless. The printing device 25 may receive printing jobs via the network. Further, optionally, the controller of the printer may be provided with a USB port, so printing jobs may be sent to the printer via this USB port.

FIG. 1*b* shows an ink jet printing assembly 3. The ink jet printing assembly 3 comprises a supporting device configured to support an image receiving member 2. The supporting device is shown in FIG. 1*b* as a platen 1, but alternatively, the supporting device may be a flat surface. The platen 1, as depicted in FIG. 1*b*, is a rotatable drum, which is rotatable about its axis as indicated by arrow A. The supporting device may be optionally provided with suction holes for holding the image receiving member in a fixed position with respect to the supporting device. The ink jet printing assembly 3 comprises print heads 4*a*-4*d*, mounted on a scanning print carriage 5. The scanning print carriage 5 is guided by suitable guides 6, 7 to move in reciprocation in the main scanning direction B. Each print head 4*a*-4*d* comprises an orifice surface 9, which orifice surface 9 is provided with at least one orifice 8. The print heads 4*a*-4*d* are configured to eject droplets of marking material onto the image receiving member 2. The platen 1, the carriage 5 and the print heads 4*a*-4*d* are controlled by suitable controls 10*a*, 10*b* and 10*c*, respectively.

The image receiving member 2 may be a medium in web or in sheet form and may be composed of, e.g. paper, cardboard, label stock, coated paper, plastic or textile. Alternatively, the image receiving member 2 may also be an intermediate member, endless or not. Examples of endless members, which may be moved cyclically, are a belt or a drum. The image receiving member 2 is moved in the sub-scanning direction A by the platen 1 along four print heads 4*a*-4*d* provided with a fluid marking material.

A scanning print carriage 5 carries the four print heads 4*a*-4*d* and may be moved in reciprocation in the main scanning direction B parallel to the platen 1, such as to enable scanning of the image receiving member 2 in the main scanning direction B. Only four print heads 4*a*-4*d* are depicted for demonstrating the present invention. In practice, an arbitrary number of print heads may be employed. In any case, at least one print head 4*a*-4*d* per color of marking material is placed on the scanning print carriage 5. For example, for a black-and-white printer, at least one print head 4*a*-4*d*, usually containing black marking material is present. Alternatively, a black-and-white printer may comprise a white marking material, which is to be applied on a black image-receiving member 2. For a full-color printer, containing multiple colors, at least one print head 4*a*-4*d* for each of the colors, usually black, cyan, magenta and yellow is present. Often, in a full-color printer, black marking material is used more frequently in comparison to differently colored marking material. Therefore, more print heads 4*a*-4*d* containing black marking material may be provided on the scanning print carriage 5 compared to print heads 4*a*-4*d* containing marking material in any of the other colors. Alternatively, the print head 4*a*-4*d* containing black marking material may be larger than any of the print heads 4*a*-4*d*, containing a differently colored marking material.

The carriage 5 is guided by guides 6, 7. These guides 6, 7 may be rods as depicted in FIG. 1*b*. The rods may be driven by suitable drives (not shown). Alternatively, the carriage 5 may be guided by other guides, such as an arm being able to move the carriage 5. Another alternative is to move the image receiving material 2 in the main scanning direction B.

Each print head 4*a*-4*d* comprises an orifice surface 9 having at least one orifice 8, in fluid communication with a pressure chamber containing fluid marking material provided in the print head 4*a*-4*d*. On the orifice surface 9, a number of orifices 8 is arranged in a single linear array parallel to the sub-scanning direction A. Eight orifices 8 per print head 4*a*-4*d* are depicted in FIG. 1*b*, however, obviously in a practical embodiment, several hundreds orifices 8 may be provided per print head 4*a*-4*d*, optionally arranged in multiple arrays. As depicted in FIG. 1*b*, the respective print heads 4*a*-4*d* are placed parallel to each other such that corresponding orifices 8 of the respective print heads 4*a*-4*d* are positioned in-line in the main scanning direction B. This means that a line of image dots in the main scanning direction B may be formed by selectively activating up to four orifices 8, each of them being part of a different print head 4*a*-4*d*. This parallel positioning of the print heads 4*a*-4*d* with corresponding in-line placement of the orifices 8 is advantageous to increase productivity and/or improve print quality. Alternatively, multiple print heads 4*a*-4*d* may be placed on the print carriage adjacent to each other such that the orifices 8 of the respective print heads 4*a*-4*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 8. Alternatively, one or multiple print heads may be placed in a static staggered array such that the medium moves transverse along the print heads. This may be done to mark the medium in a single pass.

Upon ejection of the marking material, some marking material may be spilled and stay on the orifice surface 9 of the print heads 4*a*-4*d*. The ink present on the orifice surface 9 may negatively influence the ejection of droplets and the placement of these droplets on the image receiving member 2. Therefore, it may be advantageous to remove an excess of ink from the orifice surface 9. The excess ink may be removed for example by wiping with a wiper and/or by application of a suitable anti-wetting property of the surface, e.g. provided by a coating.

Upon exposure to the medium, dust particles, paper fibers or other debris might obstruct the orifices of the print heads 4*a*-4*d*. Removal of this debris by wiping with a wiper restores the non-obstructed condition.

Touches of the medium with the orifice surface might lead to temporary dehydration of the jetting channels. This situation is restored by purging and wiping of the print head.

Figure 1C:
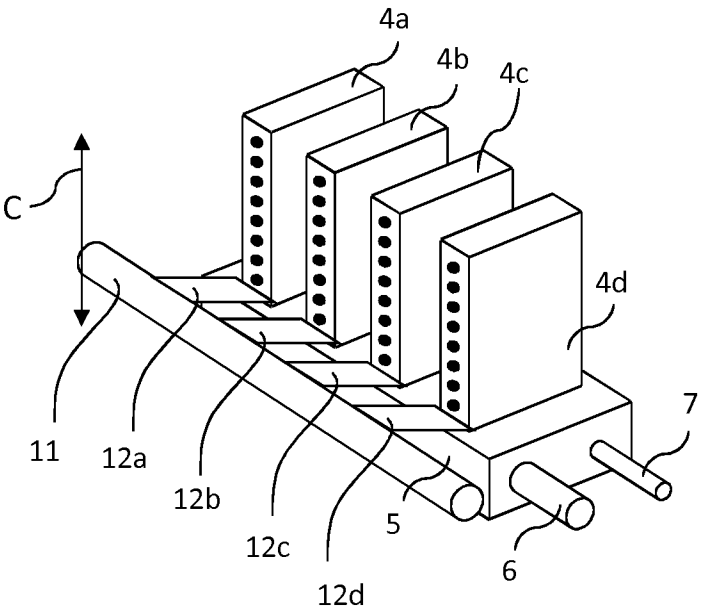
FIG. 1*c* is a perspective view of an exemplary maintenance unit comprising a wiper element.

Figure lc shows the carriage 5 supporting the four print heads 4*a*-4*d* as shown in FIG. 1*b*. Further, in FIG. 1*c*, at least a part of an exemplary maintenance unit for cleaning the print heads 4*a*-4*d* is shown. The shown maintenance unit comprises a support element 11 supporting four wiper elements 12*a*-12*d*. Each wiper element 12*a*-12*d* is a flexible sheet-like material that is arranged and configured to be brought into contact with an orifice surface 9 of a respective print head 4*a*-4*d*. The material of the wiper element 12*a*-12*d* may be suitably selected such that the ink used is suitably wiped without causing damage to the orifice surface 9. Also, other constraints may be taken into account when selecting the material and other properties and characteristics of the wiper elements 12*a*-12*d*. In this embodiment, the wiper elements 12*a*-12*d* are coupled via the support element 11, but wiper elements may also be decoupled and moveable independently from each other.

Another maintenance unit may comprise similar wiper elements that wipe in another direction, for example. Another maintenance unit may use wiper elements of absorbing material that clean the orifice surface by either wiping, touching or rolling. Further, in another embodiment, prior to wiping or other maintenance operation, a cleaning fluid or other suitable fluid may be provided on the orifice surface 9, e.g. for dissolving debris and/or dried ink. In another embodiment, instead of or together with wiping, a suction device may be moved along the orifice surface 9 for sucking fluid and debris and other undesired material from the orifice surface 9. In a particular embodiment, the suction device may even be configured to suck a small amount of ink through the orifice 8 in order to remove any debris and/or dried ink out of the orifice 8 and/or the ink chamber that is in fluid communication with the orifice 8.

Figure 2:
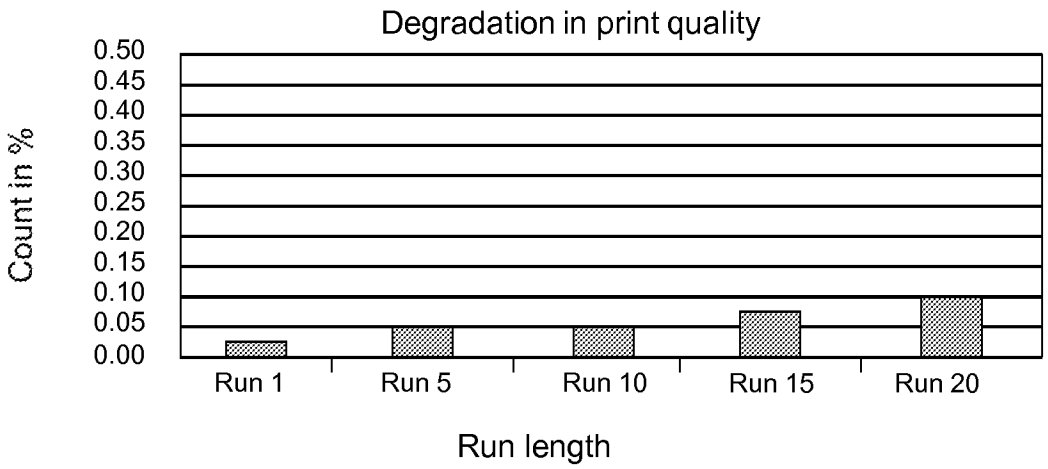
FIG. 2 is a graph depicting the average decrease in print quality as a function of the number of prints.

FIG. 2 is a column graph depicting the average decrease or degradation in print quality as a function of the number of prints. The degradation of a print head is a stochastic process. For a printing device over multiple print jobs/runs, the average degradation in print quality is determined during the run. The column graph in FIG. 2 shows the expected number of bad prints with an unacceptable print quality. In a run of 10 prints (Run 10 in FIG. 2), there is a 5% chance of getting bad prints. For a run of 20 prints (Run 20 in FIG. 2) the chance of getting bad prints has increased to 10%.

The mentioned run lengths of 10 and 20 are arbitrarily chosen and other, larger run lengths, for example a run length in the order of 100, 1000 and 10,000 prints are conceivable for application of the methods according to the present invention. The findings as shown in FIG. 2 will be used later on to explain why the print quality is increased by using a method according to the present invention. For convenience reasons the maximum allowed time interval is set to 20 prints. It is assumed that the page utilization degree is approximately constant for the pages to be printed. However, documents with varying page utilization degree may be printed using the method according to the present invention by changing the maximum allowed time interval into a new time interval taking into account the page utilization degree of each page. The new maintenance time intervals may be inversely proportional to the page utilization degree.

FIGS. 3-6 are schematic views of time lines for print jobs in relation to maintenance time intervals according to the present invention. For convenience reasons, it is assumed that the duration of the maintenance action is small, e.g. near zero. However, the scope of the present invention also includes a maintenance action duration that is substantial with respect to a time needed to print a page on the printing device. The maintenance actions are presented in the figures by vertical line pieces of the bold time lines.

Figure 3:
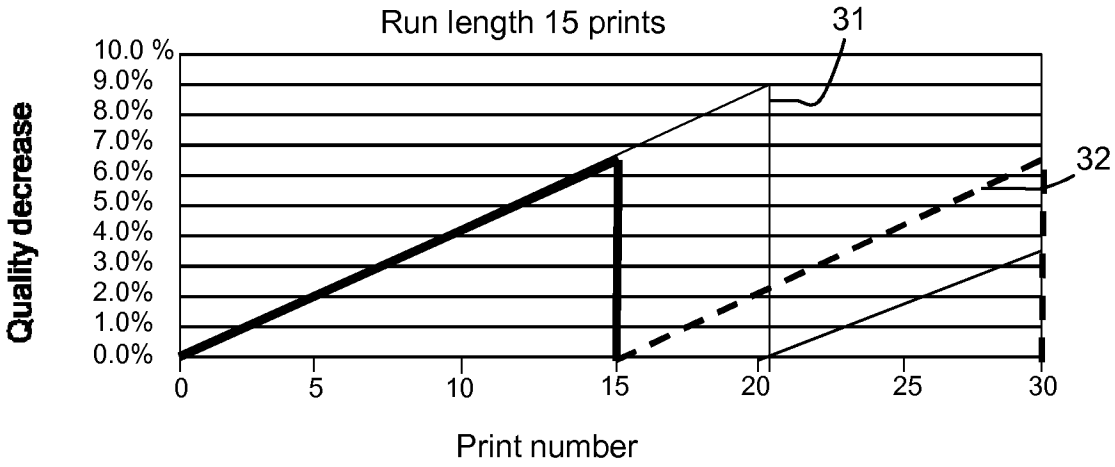
FIGS. 3, 4*a*, 4*b*, 5*a*, 5*b* and 6 are schematic views of time lines for a print job in relation to maintenance time intervals according to the present invention.

FIG. 3 shows a time line for a first job of 15 prints that have to be printed. The maximum allowed time interval is predetermined to be equal to 20 prints in order to keep the print quality decrease level beneath 10% of quality decrease (See FIG. 2). The number of 15 prints of the first print job is less than the predetermined maximum allowed time interval between the maintenance actions being 20 prints. When keeping the predetermined maximum allowed time interval, a line 31 is followed and a maintenance action will take place within a second print job. The average print quality decrease of the first job is equal to 4.5% quality decrease. The fluctuation in print quality decrease in the first job ranges from 0% to 9% quality decrease. In this case, the maintenance interval is changed to 15 prints. So immediately after the first job, the maintenance action is scheduled. The average print quality decrease during the first job is now 3.37% and the fluctuation in print quality decrease during the first job ranges from 0% to 6.75%. Dashed lines 32 give a line to be followed when a second run of 15 prints is scheduled after the first run of 15 prints.

Figure 4A:
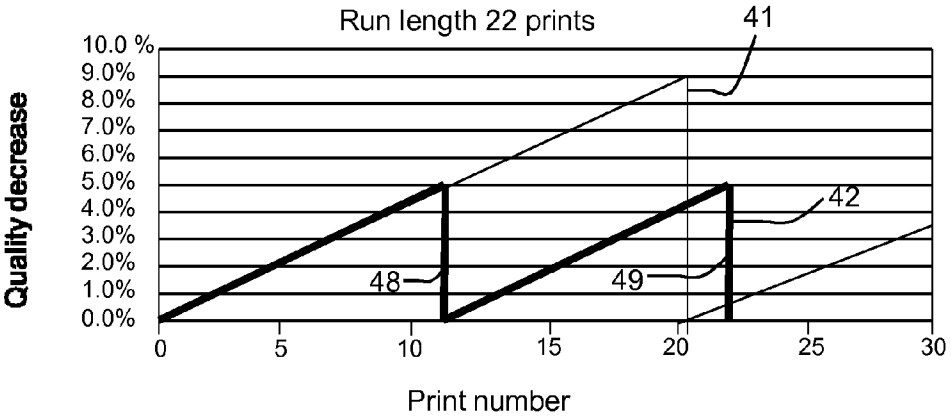

FIG. 4*a* shows a time line for a print job of 22 prints that have to be printed. The predetermined maximum allowed time interval is equal to 20 prints in order to keep the print quality decrease level beneath 10% of quality decrease. The number of 22 pages of the print job is more than the predetermined maximum allowed time interval between the maintenance actions being 20 prints. When keeping the predetermined maximum allowed time interval, a saw tooth line 41 is followed and a maintenance action will take place within the print job after 20 prints. The average print quality decrease is equal to 4.5% quality decrease. The fluctuation in print quality decrease ranges from 0% to 9% quality decrease. According to an embodiment of the present invention, the time interval between the maintenance actions is changed into a time interval of 11 prints. FIG. 4*a* shows a saw tooth time line 42 based on the new time interval of 11 prints. The average print quality decrease is now approximately equal to 2.5%. The fluctuation in print quality decrease ranges from 0% to approximately 5%. In view of this, there is less fluctuation in print quality decrease and the average print quality decrease is less than when applying the regular maintenance interval of 20 prints. The number of maintenance actions 48 during the print job is one, which is equal to the number of maintenance actions in 22 prints in total than when the regular maintenance interval of 20 prints was scheduled. So productivity is not affected. However, the decrease of average print quality decreases from 4.5% to 2.5% and its fluctuation decreases from 9% to 5%. When the predetermined maximum allowed maintenance interval of 20 pages is applied to the print job, the chance of bad quality—according to FIG. 2—is approximately 0.5*20*0.09+0.5*2*0.025=0.925 bad prints. When the new maintenance interval of 11 pages is applied to the print job, the chance of bad quality—again according to FIG. 2—is 0.5*11*0.05+0.5*11*0.05=0.55 bad prints, a win of approximately a factor of 2.

Figure 4B:
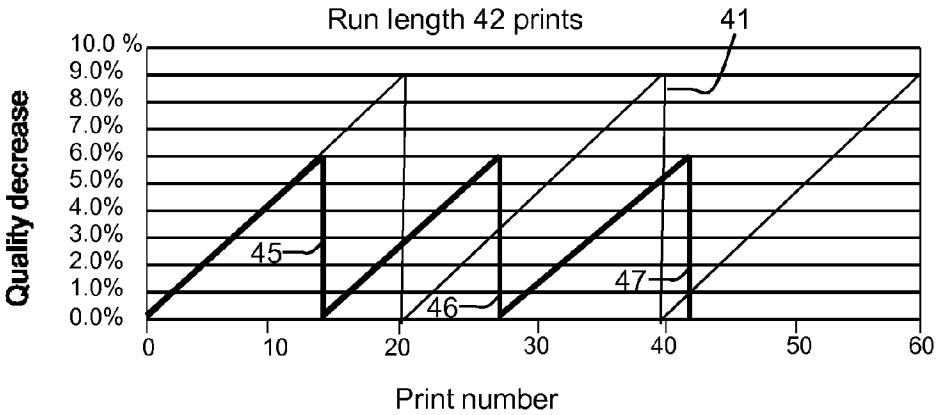

FIG. 4*b* shows a time line for a print job of 42 prints that have to be printed. The predetermined maximum allowed maintenance interval is equal to 20 prints in order to keep the print quality decrease level beneath 10% of quality decrease. The number of 42 pages of the print job is more than the predetermined maximum allowed time interval between the maintenance actions being 20 prints. When keeping the predetermined maximum allowed time interval, a saw tooth line 41 is followed and maintenance actions will take place within the print job after 20 prints and after 40 prints. And then after 2 prints, the job will be ready. The average print quality decrease is equal to 4.5% quality decrease. The fluctuation in print quality decrease ranges from 0% to 9% quality decrease. According to an embodiment of the present invention, the predetermined time interval of 20 prints is changed into a new time interval between the maintenance actions expressed in pages, for example 14, 14 and 14 prints, respectively. FIG. 4*a* shows a time line based on the new time interval of 14 prints, respectively. After 14 prints, a first maintenance action 45 is scheduled. After 28 prints a second maintenance action 46 is scheduled. Immediately after the job of 42 prints a third maintenance action 47 is scheduled. The average print quality decrease is now approximately equal to 3%. The fluctuation in print quality decrease ranges from 0% to approximately 6%. So there is less fluctuation in print quality decrease and the average print quality decrease is less than when applying the regular maintenance interval of 20 prints. The number of maintenance actions 45, 46 during the print job is equal to the number of maintenance actions when the regular maintenance interval of 20 prints was scheduled. The decrease of average print quality decreases from 4.5% to 3% and its fluctuation decreases from 9% to 6%.

Figure 5A:
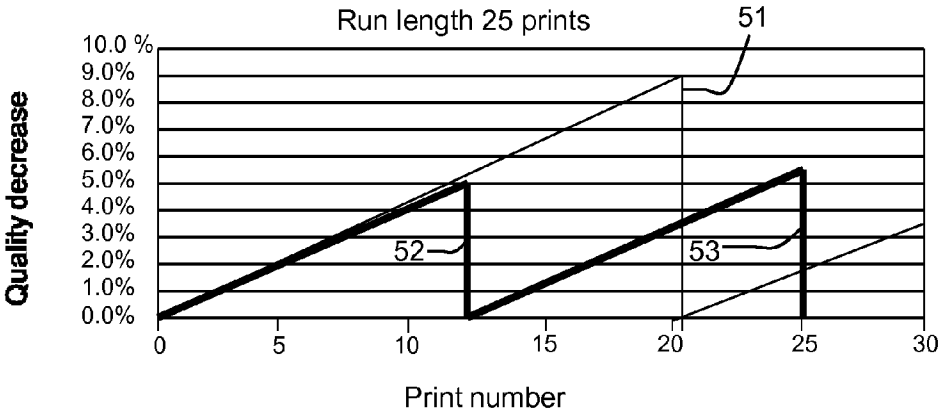

FIG. 5*a* shows a time line for a print job of 25 prints that have to be printed. The predetermined maximum allowed maintenance interval is equal to 20 prints in order to keep the print quality decrease level beneath 10% of quality decrease. The number of 25 pages of the print job is more than the predetermined maximum allowed time interval between the maintenance actions being 20 prints. When keeping the predetermined maximum allowed time interval, a saw tooth line 51 is followed and a maintenance action will take place within the print job after 20 prints. The average print quality decrease is equal to 4.5% quality decrease. The fluctuation in print quality decrease ranges from 0% to 9% quality decrease. According to an embodiment of the present invention, the predetermined time interval of 20 prints is changed into two new and different time intervals between the maintenance actions expressed in pages, for example 12 and 13 prints, respectively. FIG. 5*a* shows a time line based on the new time intervals of 12 and 13 prints, respectively. The average print quality decrease is now approximately equal to 2.5%. The fluctuation in print quality decrease ranges from 0% to approximately 5%. In view of this, there is less fluctuation in print quality decrease and the average print quality decrease is less than when applying the regular maintenance interval of 20 prints. The number of maintenance actions 52 during the print job is equal to the number of maintenance actions when the regular maintenance interval of 20 prints was scheduled. The decrease of average print quality decreases from 4.5% to 3% and its fluctuation decreases from 9% to 6%.

Figure 5B:
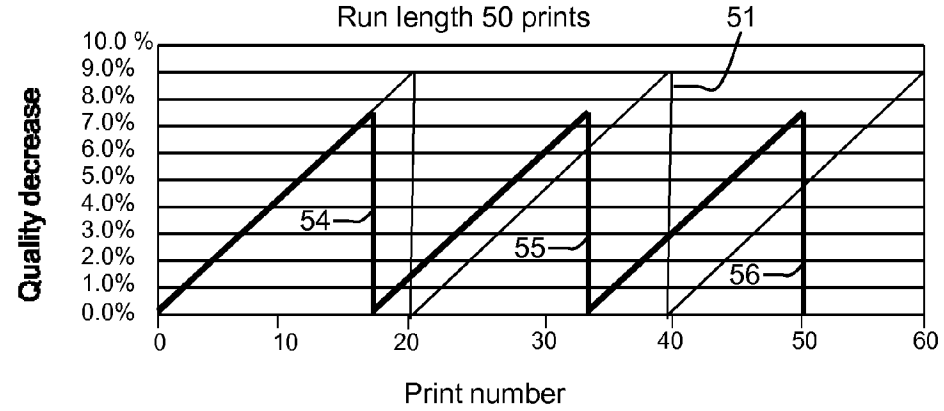

FIG. 5*b* shows a time line for a print job of 50 prints that have to be printed. The predetermined maximum allowed maintenance interval is equal to 20 prints in order to keep the print quality decrease level beneath 10% of quality decrease. The number of 50 pages of the print job is more than the predetermined maximum allowed time interval between the maintenance actions being 20 prints. When keeping the predetermined maximum allowed time interval, a saw tooth line 51 is followed and maintenance actions will take place within the print job after 20 prints and after 40 prints. And then after 10 prints the job will be ready. The average print quality decrease is equal to 4.5% quality decrease. The fluctuation in print quality decrease ranges from 0% to 9% quality decrease. According to an embodiment of the present invention, the predetermined time interval of 20 prints is changed into two new and different time intervals between the maintenance actions expressed in pages, for example 16, 17 and 17 prints, respectively. FIG. 4*a* shows a time line based on the new time interval of 16, 17 and 17 prints, respectively. After 16 prints, a first maintenance action 54 is scheduled. After 33 prints, a second maintenance action 55 is scheduled. Immediately after the job of 50 prints, a third maintenance action 56 is scheduled. The average print quality decrease is now approximately equal to 3.75%. The fluctuation in print quality decrease ranges from 0% to approximately 7.5%. In view of this, there is less fluctuation in print quality decrease and the average print quality decrease is less than when applying the regular maintenance interval of 20 prints. The number of maintenance actions 54, 55 during the print job is equal to the number of maintenance actions when the regular maintenance interval of 20 prints was scheduled. The decrease of average print quality decreases from 4.5% to 3.75% and its fluctuation decreases from 9% to 7.5%.

Figure 6:
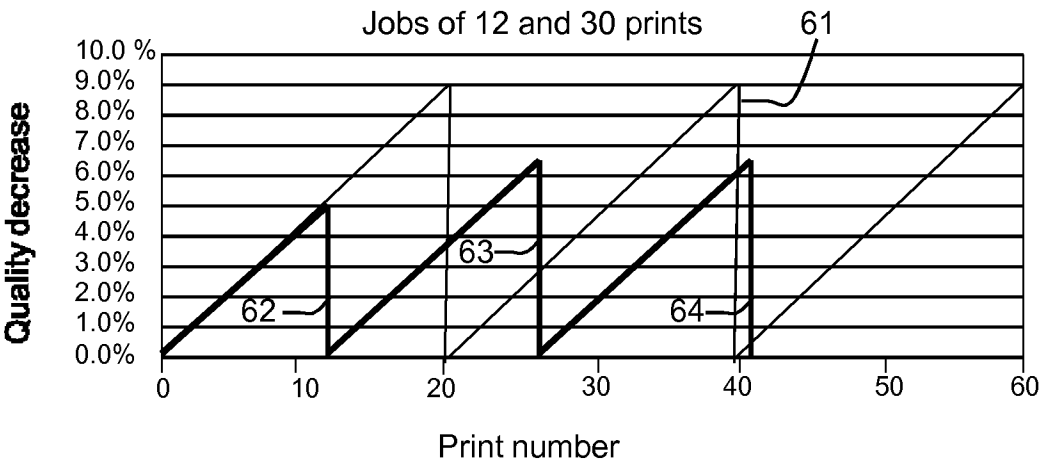

FIG. 6 shows a time line for two print jobs of 12 and 30 prints, respectively that have to be printed. The predetermined maximum maintenance interval is equal to 20 prints in order to keep the print quality decrease level beneath 10% of quality decrease. The number of 12 pages of the first print job is less than the predetermined maximum allowed time interval between the maintenance actions being 20 prints. The number of 30 pages of the second print job is more than the predetermined maximum allowed time interval between the maintenance actions being 20 prints. When keeping the predetermined maximum allowed time interval, a saw tooth line 61 is followed and maintenance actions will take place within the print job after 20 prints and after 40 prints. And then after 2 prints, the second print job will be ready. The average print quality decrease of the second print job is approximately equal to 6.5% quality decrease. The fluctuation in print quality decrease ranges from 0% to 9% quality decrease. According to an embodiment of the present invention, the predetermined time interval of 20 prints is changed into two new and different time intervals between the maintenance actions expressed in pages, being 12, 15 and 15 prints, respectively. FIG. 6 shows a time line based on the new time interval of 12, 15 and 15 prints, respectively. After 12 prints—after the first print job - a first maintenance action 62 is scheduled. After 15 prints of the second print job, a second maintenance action 63 is scheduled. Immediately after the second job of 30 prints, a third maintenance action 64 is scheduled. The average print quality decrease of the first print job is now approximately equal to 2.5%. The fluctuation in print quality decrease ranges from 0% to approximately 5%. In view of this, there is less fluctuation in print quality decrease of the first print job and the average print quality decrease of the first print job is less than when applying the regular maintenance interval of 20 prints. The average print quality decrease of the second print job is now approximately equal to 3.38%. The fluctuation in print quality decrease ranges from 0% to approximately 6.75%. In view of this, there is less fluctuation in print quality decrease of the second print job and the average print quality decrease of the second print job is less than when applying the regular maintenance interval of 20 prints. The number of maintenance actions 62, 63 during the first and second print job is equal to the number of maintenance actions when the regular maintenance interval of 20 prints was scheduled. The decrease of average print quality decreases to 2.5 respectively 3.38% for the first and second print job.

In general, the following principles are applicable according to the present invention with regard to the number of pages N to be printed and the number of pages M of the predetermined maximum allowed time interval.

When the number of prints N is less than the number of pages M of the predetermined maximum allowed time interval and more than 1 page, the maintenance interval may be changed to N pages. This results in an equal number of maintenance actions during the print job with the changed time interval as the number of maintenance actions during the print job with the predetermined time interval, or a larger number of maintenance actions during the print job with the changed time interval than the number of maintenance actions during the print job with the predetermined time interval. Also, the number of pages of a number of small consecutive print jobs may be summarized to a maximum number MAX of pages which is still smaller than or equal to M. A maintenance action may then be scheduled after MAX pages.

When the number of prints N is more than and equal to a multiple of the number of pages M of the predetermined maximum time interval, the maintenance interval may be held to M pages. In this exceptional case, the end time of printing the number of pages N coincides with the start time of a maintenance action. The number of maintenance actions during the print plus the maintenance action directly after the print job will become N/M in number. For example, if N=40 and M=20, then N/M=2. The number of maintenance action during the job and directly after the job is equal to 2.

When the number of prints N is more than and not a multiple of the number of pages M of the predetermined maximum allowed time interval, the maintenance interval is changed to a number of pages which is less than M. For example, if N=42 and M=20 (See FIG. 4*b*), then Int (N/M)=2. The number of maintenance action during the job and directly after the job will become equal to 3. The number of pages between the maintenance actions will become Int(N/(Int(N/M)+1))=Int(42/(Int (42/20)+1))=Int (42/(2+1))=Int (42/3)=14. In this example N is a multiple of Int (N/M+1). In the case that N is not a multiple of Int (N/M+1), two maintenance intervals each having a different duration of a different number of pages may replace the predetermined time interval. At least one of the two maintenance intervals is less than M pages. The two maintenance intervals may comprise a maintenance interval equal to M. It is noted that in this case two different maintenance interval durations which differ by only 1 page in duration, is sufficient to cover all situations. In each situation, it is achievable that the number of maintenance actions during the print job and the maintenance action directly scheduled after the print job together are only one maintenance action more in number than when using the predetermined maximum allowed time interval.

In an embodiment of the present invention, the number of maintenance actions during the print job may be determined to be Int (N/M). The number of pages between the maintenance actions during the print job may be selected equal to X=Int (N/(Int (N/M)+1)) or X+1. Note that X is always smaller than M, X+1 is smaller than or equal to M. In a first example, N=49 and M=20. Then X=16, X+1=17. The number of pages between the maintenance actions will become respectively 16, 16 and 17 or any permutation of the numbers 16, 16, 17. In a second example, N=50 and M=20. Then X=16, X+1=17. The number of pages between the maintenance actions will become respectively 16, 17 and 17 or any permutation of the numbers 16, 17, 17. In a third example N=51 and M=20. Then X=17. The number of pages between the maintenance actions will become respectively 17, 17 and 17. In a third example, N=52 and M=20. Then X=17, X+1=18. The number of pages between the maintenance actions will become respectively 17, 17 and 18 or any permutation of the numbers 17, 17, 18.

Figure 7A:
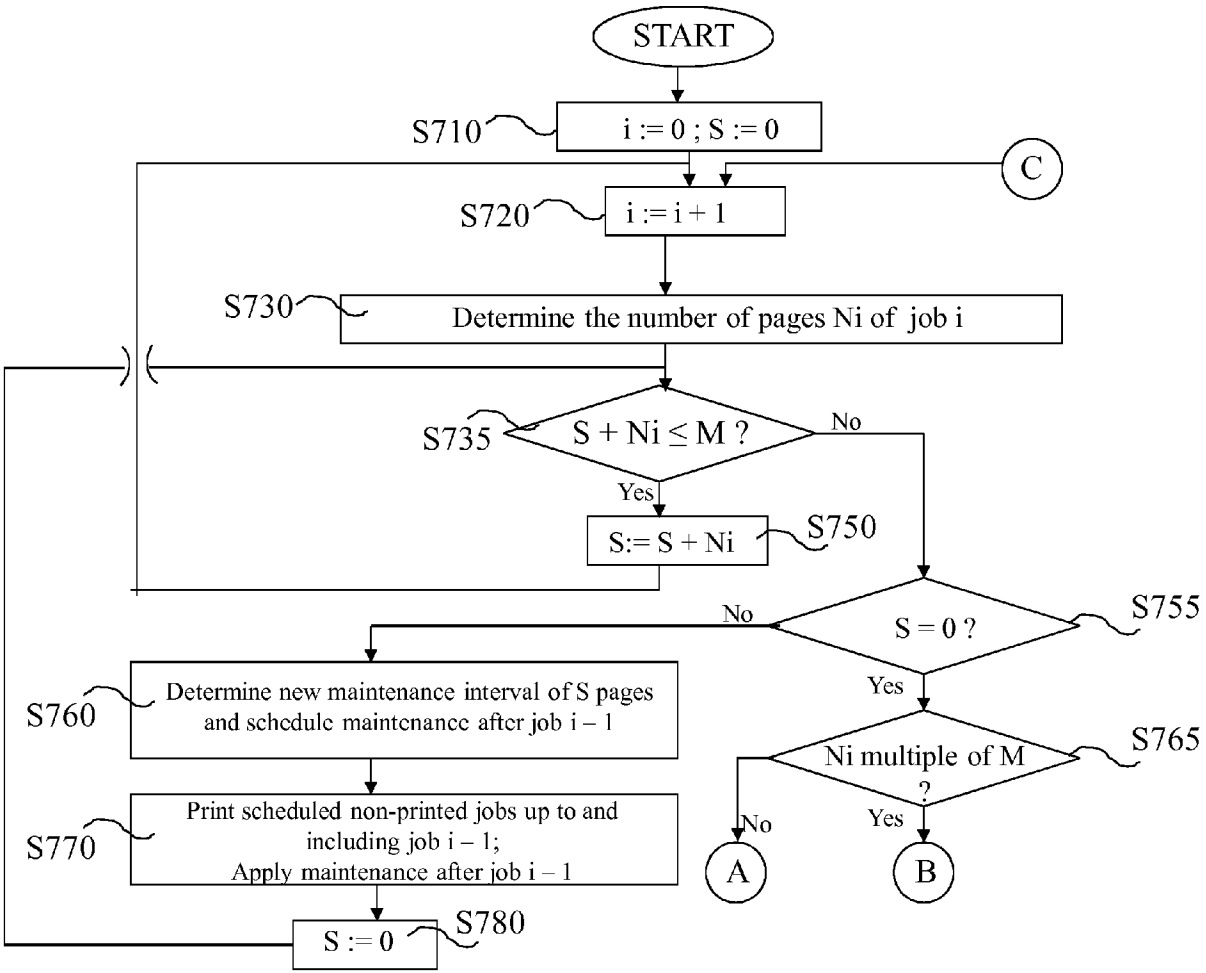
FIGS. 7*a*-7*b* are a flow diagram of an embodiment of the method according to the present invention.
Figure 7B:
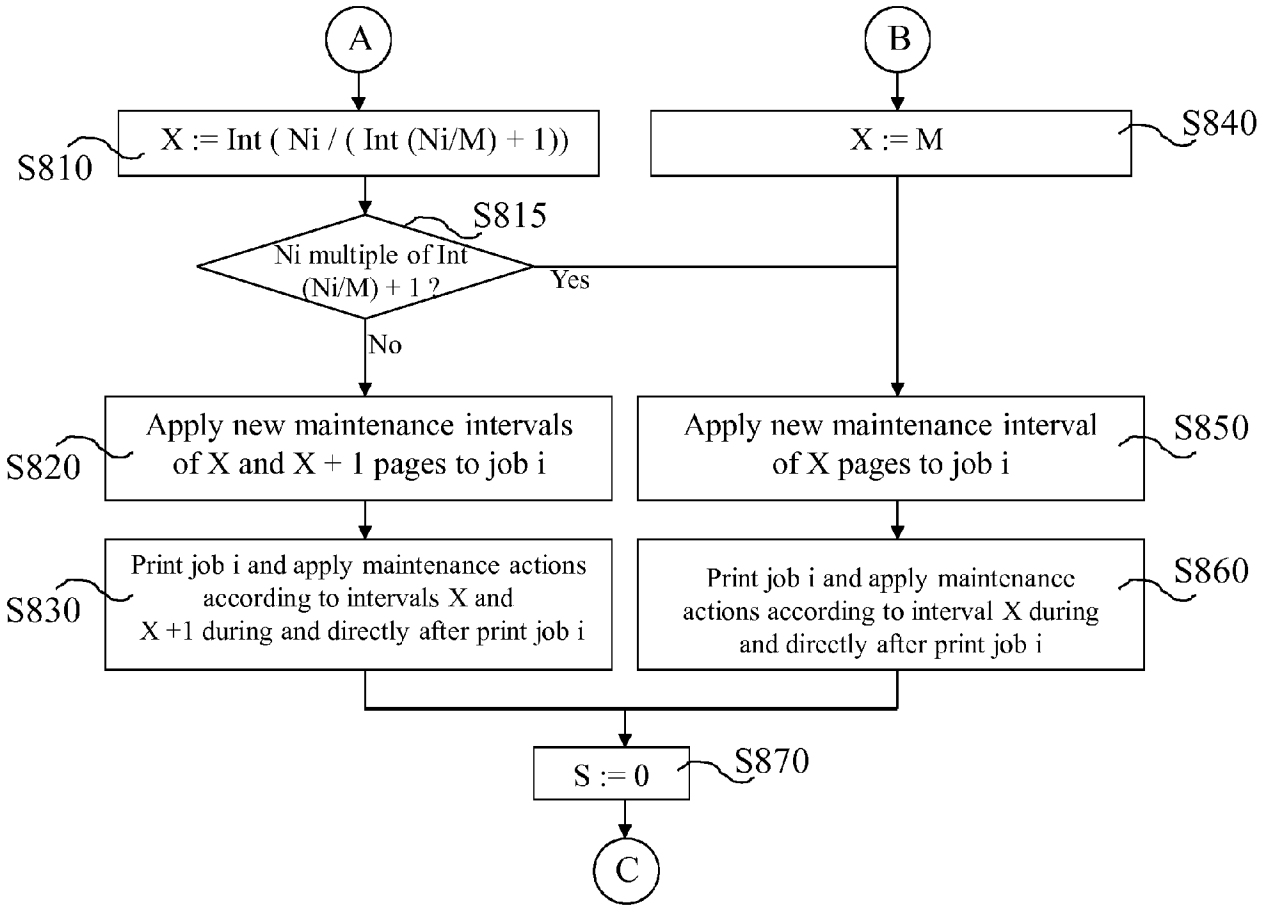

FIGS. 7*a*-7*b* are a flow diagram of an embodiment of the method according to the present invention. M is defined as the predetermined maximum allowed time interval specified as a number of pages.

In a first step S710, variables i and S are initialized to zero. Variable i counts the print jobs to be processed and variable S summarizes the number of pages of the jobs that are scheduled.

In a second step S720, the variable i in incremented by one.

In a third step S730, the next job i is read and the number of pages Ni of job i is determined by the control unit of the printing device.

In a fourth step S735, a comparison is made between S+Ni and M. If S+Ni≤M, then S is incremented with Ni in a fifth step S750 and the procedure returns to the second step S720 for reading the next job. If S+Ni>M, then the procedure proceeds with the sixth step S755.

In the sixth step S755, it is checked if S is equal to zero. If S is not equal to zero, previous non-printed scheduled jobs have to be printed first. Therefore, in a seventh step S760, a new maintenance interval is determined to be equal to S pages and a maintenance action is scheduled after job i−1.

In an eighth step S770, the non-printed scheduled print jobs up to and including job i−1 are printed. Immediately after job i−1 has been printed, a maintenance action is carried out.

In a ninth step S780, the variable S is reset to zero and the procedure returns to the fourth step S735.

The steps S750, S760, S770 and S780 are for example applied to the print jobs according to FIG. 6, when applying maintenance action 62, and in FIG. 3*a*, when applying a maintenance action after print number 15 of the first job.

If the check in the sixth step S755 delivers that S is equal to zero, a tenth step S765 is carried out.

In the tenth step S765, it is checked if Ni is a multiple of M. If so, the method proceeds to label B, which is also visible in FIG. 7*b*. If not so, the method proceeds to label A, which is also visible in FIG. 7*b*.

From label A, an eleventh step S810 is executed which defines a number X which equals Int (Ni/(Int (Ni/M)+1)). In a twelfth step S815, it is checked if Ni is a multiple of Int(Ni/M)+1. If so, the method proceeds with the thirteenth step S850 which is explained later. If not so, the method proceeds with the fourteenth step S820.

In the fourteenth step S820, two new maintenance intervals of X pages and X+1 pages are applied to the pages of job i. The first new maintenance interval of X pages and the second new maintenance interval of X+1 pages are together applied Int (Ni/M)+1 times to the job i. The first maintenance interval of X pages is applied (X+1)*(Int (Ni/M)+1)−Ni times to the job i. The second maintenance interval of X+1 pages is applied Ni−X*(Int (Ni/M)+1) times to the job i. In a fifteenth step S830, the job i is printed and maintenance actions are carried out during the print job and directly after printing of job i according to the two new maintenance intervals X and X+1.

In a sixteenth step S870, the variable S is reset to zero and the method proceeds to label C, which is also visible in FIG. 7*a* and leads back to the second step S720 in order to proceed with the next print job.

From label B, a seventeenth step S840 is executed which defines a number X as the new maintenance interval which equals M.

In the thirteenth step S850, one new maintenance interval of the X number of pages is applied to the pages of job i.

In a nineteenth step S860, the job i is printed and maintenance actions are carried out during the print job and directly after printing of job i according to the one new maintenance interval X. Then, the method proceeds with the sixteenth step S870 which is explained here-above in the label A branch.

According to an alternative embodiment, the method returns from the label C to the first step S710 instead of the second step S720. This is in particular advantageous, when there are pauses between print jobs. If such a pause is substantial, the counter I is reset to zero and the jobs are counted from zero again.

According to an alternative embodiment, the tenth step 765 and the use of the labels A and B are avoided, by using another formula for the number of maintenance actions during the print job. Namely, the number of maintenance actions during the print job is equal to Int ((Ni−1)/M), which is also true is if Ni is a multiple of M.

The steps S810, S815, S820 and S830 are for example applied for the print job according to FIG. 5*a* and FIG. 5*b*. The steps S810, S815, S850 and S860 are for example applied for the print job according to FIG. 4*a* and FIG. 4*b*.

Programming steps being alternative to and equivalent to the steps in FIGS. 7*a* and 7*b* may be envisioned to achieve the embodiments of the method according to the present invention.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A method of establishing a time interval between consecutive maintenance actions for a printing device, the method comprising the steps of:

determining a job time needed to print an incoming print job;

comparing the determined job time to a predetermined maximum allowed time interval between the maintenance actions;

if the determined job time is larger than the maximum allowed time interval, scheduling a plurality of maintenance actions, at least one maintenance action during the printing of the print job and a maintenance action at the end of the print job being such that for each pair of consecutive maintenance actions a time interval between the consecutive maintenance actions of each pair is smaller than the predetermined maximum allowed time interval and the plurality of maintenance actions are substantially equidistantly distributed in time;

if the determined job time is not larger than the maximum allowed time interval, scheduling a maintenance action after printing of the incoming print job; and printing the incoming print job, including carrying out the at least one scheduled maintenance action.

2. The method according to claim 1, wherein the number of pages between two consecutive maintenance actions during the print job are substantially the same.

3. The method according to claim 1, wherein the scheduling step of the plurality of maintenance actions establishes an equal number of maintenance actions during the print job as when the print job was carried out using the maximum allowed time interval.

4. The method according to claim 1, further comprising the step of determining the time interval between consecutive maintenance actions of the plurality of maintenance actions to have at most two different time period sizes.

5. The method according to claim 1, wherein the step of scheduling the plurality of maintenance actions further comprises the step of taking a utilization degree of each page of the print job into account.

6. The method according to claim 1, wherein the printing device is a single pass printing device.

7. The method according to claim 1, wherein a kind of maintenance action is at least one of a cleaning action of the print head of the printing device, a wiping action of the print head of the printing device, and a flushing action of the print head of the printing device.

8. The method according to claim 7, further comprising the step of differentiating the maximum allowed time interval with respect to the kind of the maintenance action.

9. The method according to claim 1, further comprising the step of differentiating the maximum allowed time interval with respect to a page size of the pages of the print job.

10. A printing device comprising:

a print unit; and a print controller for planning maintenance actions on the print unit according to the method according to claim 1.

11. A non-transitory recording medium comprising computer executable program code configured to instruct a computer to perform the method according to claim 1.

* * * * *